US010012043B1

(12) United States Patent
Hancock et al.

(10) Patent No.: US 10,012,043 B1
(45) Date of Patent: Jul. 3, 2018

(54) PROCESS AND SYSTEM FOR RECOVERY OF SOLIDS FROM A DRILLING FLUID

(71) Applicants: John C. Hancock, League City, TX (US); Ben Hiltl, Houston, TX (US); Octavio Perez, Houston, TX (US)

(72) Inventors: John C. Hancock, League City, TX (US); Ben Hiltl, Houston, TX (US); Octavio Perez, Houston, TX (US)

(73) Assignee: FSI HOLDINGS, LLC, Houston, TX (US)

( * ) Notice: Subject to any disclaimer, the term of this patent is extended or adjusted under 35 U.S.C. 154(b) by 729 days.

(21) Appl. No.: 14/099,168

(22) Filed: Dec. 6, 2013

(51) Int. Cl.
*E21B 21/01* (2006.01)

(52) U.S. Cl.
CPC ..... *E21B 21/01* (2013.01)

(58) Field of Classification Search
None
See application file for complete search history.

(56) References Cited

U.S. PATENT DOCUMENTS 2,982,401 A 5/1961 Talbot
3,025,965 A * 3/1962 Bergman ..... B04C 5/16 175/206
3,737,037 A 6/1973 Bone
4,192,392 A * 3/1980 Messines ..... E21B 21/065 175/206
4,482,459 A 11/1984 Shriver
4,804,461 A 2/1989 Heinrich
4,836,302 A 6/1989 Heilhecker et al.
6,036,870 A 3/2000 Briant et al.
6,042,032 A * 3/2000 Pinoncely ..... B02C 21/00 241/24.1
7,867,399 B2 1/2011 Jones et al.
2002/0074269 A1 6/2002 Hensley et al.
2005/0236015 A1 10/2005 Goel et al.
2007/0221411 A1* 9/2007 Butler ..... E21B 21/066 175/66
2012/0024602 A1 2/2012 Larson
2013/0256037 A1* 10/2013 Bender ..... E21B 21/01 175/66

* cited by examiner

*Primary Examiner* — Michael H Wilson
*Assistant Examiner* — Katherine Will
(74) *Attorney, Agent, or Firm* — Egbert Law Offices, PLLC

(57) ABSTRACT

A process for recovery of solids from a drilling fluid includes the steps of passing a solids-containing drilling fluid through a grinder, grinding the solids from the drilling fluid to a desired size, pumping the ground solids and the drilling fluid to hydrocyclone such that the hydrocyclone produces an overflow and an underflow. The overflow contains low-density solids and the underflow contains high-density solids. The high-density solids are passed to a container. The solids-containing drilling fluid is shaken prior to the step of grinding so as to remove oversize solids from the drilling fluid. The ground solids are pumped to the hydrocyclone at a generally constant pressure.

14 Claims, 2 Drawing Sheets

PROCESS AND SYSTEM FOR RECOVERY OF SOLIDS FROM A DRILLING FLUID

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the recovery of solids, such as barite, from a drilling fluid. More particularly, the present invention relates to the use of hydrocyclones for the treatment of the drilling fluid so as to remove solids therefrom. Additionally, the present invention relates to processes and systems in which the high-density solids from the drilling fluid can be returned for reuse within the drilling system.

2. Description of Related Art Including Information Disclosed Under 37 CFR 1.97 and 37 CFR 1.98.

Drilling fluid is used to aid the drilling of boreholes into the earth. Liquid drilling fluid is often referred to as "drilling mud". The three main categories of drilling fluids are water-based muds (which can be dispersed and non-dispersed), non-aqueous muds, usually called oil-based muds, and gaseous drilling fluid, in which a wide range of gases can be used.

The main functions of drilling fluids include providing hydrostatic pressure to prevent formation fluids from entering into the wellbore, keeping the drill bit cool and clean during drilling, carrying out drill cuttings, and suspending the drill cuttings while drilling is paused and when the drilling assembly is brought in and out of the hole. The drilling fluid used for a particular job is selected to avoid formation damage and to limit corrosion.

Most basic water-based mud systems begin with water, then clays and other chemicals are incorporated into the water to create a homogenous blend. The clay is usually a combination of native clays that are suspended in the fluid while drilling, or specific types of clay that are processed and sold as additives for the water-based mud system. The most common of these is bentonite, frequently referred to in the oil field as "gel". Many other chemicals (e.g. potassium formate) are added to a water-based mud system to achieve various effects, including: viscosity control, shale stability, enhanced drilling rate of penetration, cooling and lubricating of equipment.

On a drilling rig, mud is pumped from the mud pits through the drill string where it sprays out of nozzles on the drill bit, cleaning and cooling the drill bit in the process. The mud then carries the crushed or cut rock ("cuttings") up the annular space between the drill string in the sides of the hole being drilled, up through the surface casing, where it emerges back to the surface. Cuttings are then filtered out with either a shale shaker and the mud returns to mud pits. The mud pits let the drilled "fines" settle. The pits are also where the fluid is treated by adding chemicals and other substances.

Water-based drilling mud most commonly consists of bentonite clay with additives such as barium sulfate (barite), calcium carbonate or hematite. Presently, barite is in short supply. As such, barite becomes a very costly item for the drilling operation. Also, the lack of availability of barite enhances the desire for operators to conserve the barite as much as possible and to avoid the loss of barite during the drilling processes. Barite is added to the drilling fluid to increase the overall density of the drilling fluid so that sufficient bottom hole pressure can be maintained so as to prevent an unwanted (and often dangerous) influx of formation fluids.

In addition to drill bit cooling, lubrication, and cuttings removal, the drilling fluid is used for well control. For instance, the mud is used to prevent formation fluid from entering the wellbore. When the hydrostatic pressure of mud in the wellbore annulus is equal to or greater than the formation pressure, formation fluid will not flow into the wellbore and mix with the mud. The hydrostatic pressure of the mud is dependent upon the mud density and the vertical depth. Thus, to prevent formation fluid from flowing into the wellbore, the mud is selected based on its density to provide a hydrostatic pressure exceeding the formation pressure. At the same time, however, the hydrostatic pressure of the mud must not exceed the fracture strength of the formation, thereby causing mud filtrate to invade the formation and a filter cake of mud to be deposited on the wellbore wall.

As wells become deeper, the balancing of these two operational constraints becomes increasingly difficult. Moreover, in deep wells more than 30,000 feet below sea level and in water deeper than 10,000 feet, balancing these constraints is not possible because the weight of mud required to produce a hydrostatic pressure exceeding the formation pressure also produces a hydrostatic force exceeding the fracture strength of the formation. When such conditions exist, one solution that allows continued drilling is to case the wellbore. Drilling then continues for a time before it is interrupted again and another casing string installed. Drilling then resumes, and so on. Setting multiple casing strings in this manner is, however, very expensive and eventually reduces the diameter of the wellbore to the extent that further drilling is not warranted. Another technique that is been recently available is the use of a dual density drilling fluid for use in such formations.

The dual density drilling system uses two fluids with different densities in the wellbore as opposed to the single density fluid used in conventional drilling. These two fluids can give a more favorable pressure profile in the well when compared to conventional drilling. The dual density approach changes the overall pressure versus depth profile compared to conventional drilling with a single density fluid. This is what allows dual density drilling to drill deeper before setting casing, as compared to conventional drilling. This favorable pressure profile can reduce costs in deep water drilling activity because it would reduce the number of casing strings needed and the danger involved with kick control. The more favorable pressure profile is produced by having the lower density fluid in the riser at or near the density of seawater and a higher density fluid, providing overbalance for the trip margin, in the wellbore. This arrangement produces two different fluid gradients in the well. The low density liquid is injected into the riser at the seafloor. The wellbore fluid, which is of the highest density, flows through the drill pipe, the bit, and back up the wellbore annulus. The combination of these two streams gives the resultant riser fluid.

In the past, centrifuge systems have been utilized for the purpose of recovering the high density solids, such as barite, from the drilling fluid. FIG. 1 is an illustration of a prior art system in which a centrifuge is utilized so as to recover the high density solids from the drilling fluid.

As can be seen in FIG. 1, the centrifuge system 10 initially receives the drilling fluid from a rig 12. The solids-containing drilling fluid is passed along line 14 to a shaker 16. The shaker 16 is a conventional shaker system that serves to remove large rocks and particles from the drilling fluid. Typically, a shaker will include a screen which vibrates so that the large particles are passed as an overflow outwardly along line 18 for disposal. It can be seen that the oversized solids are removed from the drilling fluid 14 by the shaker 16. The smaller particles contained within the drilling fluid are then passed outwardly along line 20 to a first tank 22. A pump 24 serves to draw the solids-containing drilling fluid from first tank 22 along line 26 and outwardly toward a centrifuge 28. Since the centrifuge 28 has a relatively small capacity (i.e. less than 200 gallons per minute for barite recovery), only a portion of the flow from the pump 26 will pass along line 30 into the centrifuge 28. Another portion of the flow will pass along bypass line 32.

The centrifuge 28 is a low G-force centrifuge. As such, it serves to treat a larger flow of the solids-containing drilling fluid. The centrifuge works by providing strong centrifugal forces to the solids-containing drilling fluid such that the solids will pass as an underflow along line 34 and the a low-density fluid will pass outwardly as an overflow along line 36 from the centrifuge 28. The high-density fluid passing along line 34 will be delivered to a tank 40. The low density drilling fluid will pass along line 36 to another tank 42. The high-density drilling fluid from tank 40 is pumped through line 44 through a pump 46 and toward a mud tank 48. Mud additives are delivered along line 50 to the tank 48. The low-density drilling fluid in tank 42 is drawn through pump 52 to a high G-force centrifuge 54. The high G-force centrifuge 54 is a polishing centrifuge which serves to remove undersize solids for disposal along line 56. The remaining liquid will pass as an overflow through line 58 into tank 48 for mixture with the high-density drilling fluid in tank 58. A mud pump 60 will draw the high-density drilling fluid from tank 48 through line 62 and pass the fluid along line 64 for use by the rig 12.

In the configuration shown in FIG. 1, a pair of centrifuges 28 and 54 are required for the proper treatment of the solids-containing drilling fluid. Importantly, centrifuges are relatively complex pieces of equipment and are very expensive. Typically, each centrifuge can cost over one million dollars. Since the centrifuges are very complex pieces of equipment, highly trained personnel are required in order to properly control the equipment. The centrifuges have a relatively low capacity. As such, the drilling fluid can only be treated at a relatively low rate. As such, additional drilling fluid may have to be added to the system following the centrifuge-treatment in order to satisfy the requirements of the drilling rig 12. When the new drilling fluid is added, additional quantities of barite will be required. This further adds cost and expense to the system. Centrifuges are desired because of the fact that they seldom clog. However, the complexity of the centrifuges often add significant maintenance expenses to the treatment process. It is also very difficult to properly size the centrifuges or array of centrifuges to the requirements of the rig system.

In offshore application in association with dual density drilling fluid, the centrifuges become increasingly impractical. In view of the need to inject one density of drilling fluid adjacent to the sea floor, it would be necessary to install a centrifuge adjacent to the sea floor. Since this is virtually impossible, the high-density drilling fluid at the sea floor is delivered to the surface (a considerable distance) and then treated at the surface so as to preserve the barite, and then re-injected as a light stream to dilute the riser. Additionally, in offshore output applications, these expensive centrifuges may need repair. It is very difficult to deliver additional centrifuges to the offshore location. As such, this necessitates the need to provide several centrifuges (above operation requirements) in order to satisfy the requirements in the event that one of the centrifuges should become disabled. Once again, this adds significantly to the expense of preserving the barite within the drilling fluid treatment system. As such, a need has developed so as to provide a proper system for the recovery of solids from drilling fluid that avoids the problems associated with centrifuges.

In the past, various patents have issued relating to the recovery of solids from drilling fluids. For example, an early patent was U.S. Pat. No. 2,982,401, issued on May 2, 1961 to C. F. Talbot. This patent describes a process for reclaiming barite from waste drilling fluids. This process includes the steps of collecting used drilling mud substances, washing the substances with water to remove soluble components therefrom, elutriating the substances remaining after washing to remove the insoluble components including bentonite and drilling cuttings, thickening the heavier substance comprising barite constituents remaining after elutriating to a desired consistency, subjecting the heavier substance (including the barite constituents) to a froth floatation to recover the barite constituents from the substance. The recovered heavier substance (including barite) is dried for subsequent use.

U.S. Pat. No. 3,737,037, issued on Jun. 5, 1973 to L. Bone, provides a drilling fluid treatment to remove substantially all suspended solid particles. The drilling fluid is centrifuged to remove particles of sizes down to about 20 microns in diameter followed by adding a flocculating agent to form flocs of particles from about 20 microns to less than 2 microns in the diameter. The flocs are filtered from the drilling fluid provide a liquid substantially free of suspended solid particles for reuse as a drilling fluid.

U.S. Pat. No. 4,482,459, issued on Nov. 13, 1984 to C. Shriver, discloses a continuous process for the reclamation of waste drilling fluids. The process includes the step of conducting the drilling mud slurry to a slurry surge tank for liquid solid separation by chemical and physical methods. The mud slurry is subjected to a primary solids separation unit after pH adjustment is used to initiate coagulation and an organic flocculant is added to aid flocculation of the solids. The water is then subjected to a secondary solids removal and the solids that are recovered are reintroduced to the primary solids separation unit.

U.S. Pat. No. 4,804,461, issued on Feb. 14,1989 provides a process for recovering barite from drilling muds. In particular, this method utilizes classifying processes during drilling rig operation so as lead to the disposal of fine grained barite. A simple one-stage flotation process utilizes alkylphosphate-based collecting and foaming reagents is applied to recover the barite content of such muds. The flotation is carried out at a pH of 8 to 9 with regulating reagents.

U.S. Pat. No. 4,836,302, issued on Jun. 6, 1989 to Heilhecker et al., teaches an apparatus and method for removing oil-based drilling mud additives from drilling cuttings. The oil-based mud-laden cuttings are transported to a solid feed tank wherein the oil-based cuttings are subjected to turbulent mixing to leave the surface of the cuttings substantially free of oil. The cuttings are then transported to a countercurrent flow column and subjected to a countercurrent laminar flow of solvent in order to separate oily solvents and fines smaller than a chosen diameter from the heavier solids. The heavier solids are cleaned of any remaining oil-based muds, separated from the cleaning solvent, and returned to the sea environment. The method further includes the step of treating the oil-based mud-laden solvent for separation of remaining solvent for return of the solvent to the continuous process and for the recycling of the recovered oil-based drilling mud to the drilling mud system.

U.S. Pat. No. 6,036,870, issued on Mar. 14, 2000 to Briant et al., provides a method of wellbore fluid recovery using centrifugal force. A wellbore fluid mixture is led to a decanting centrifuge. The wellbore fluid includes at least one liquid component and undesirable solids. The undesirable solids are separated from the wellbore fluid with the decanting centrifuge so as to produce an intermediate fluid containing the liquid content component and a reduced amount of the undesired solids. The intermediate fluid is fed to a secondary centrifuge so as to produce a final fluid containing the liquid component and a reduced amount of the undesired solids.

U.S. Pat. No. 7,867,399, issued on Jan. 11, 2011 to Jones et al., discloses a method for treating drilling mud. The method includes the step of removing the coarse solids from the mud, breaking the emulsion and separating the hydrophobic phase from the water phase and the solid phase. The residual water and oil are vaporized from the solids and burned off of the vaporized oil.

U.S. Patent Publication No. 2002/0074269, published on Jun. 20, 2002 to Hensley et al., provides a drilling mud clarification or reclamation system. High gravity and low gravity solids are removed from the drilling mud in respective centrifugal separator stages. A plurality of in-line mass flow sensors are provided provide real-time indication of the effectiveness of the clarification of the drilling mud and provide control system to a central control station. The heavier weight components are separated from the mud and returned to the system for further use. The lighter weight components are removed and discarded to clean the mud. A de-sludging centrifuge is provided to remove very fine cuttings.

It is an object of the present invention to provide a process and system for the recovery of solids from a drilling fluid that is relatively inexpensive.

It is still another object of the present invention to provide a process and system for the recovery of solids from a drilling fluid that has minimal maintenance costs.

It is still another object of the present invention to provide a process and system for recovery of solids from a drilling fluid that effectively recovers the solids from the drilling fluid.

It is still another object of the present invention to provide a process for the recovery of solids from a drilling fluid which effectively separates the high-density fluids from the low-density fluids.

It is still further object of the present invention to provide a process and system for the recovery of solids from a drilling fluid that minimizes the loss of barite and facilitates the reuse of existing barite.

it is still another object of the present invention to provide a process and system for the recovery of solids from the drilling fluid that minimizes the need to re-inject fluids into the process.

It is still further object of the present invention to provide a process and system for the recovery of solids from a drilling fluid that can be effectively sized to the requirements of the drilling system.

It is still another object of the present invention to provide a process and system for the recovery of solids from a drilling fluid that can be operated by relatively untrained personnel.

These and other objects and advantages of the present invention will become apparent from a reading of the attached specification and appended claims.

BRIEF SUMMARY OF THE INVENTION

The present invention is process for the recovery of solids from a drilling fluid. The process of the present invention includes the steps of: (1) passing a solids-containing drilling fluid through a grinder; (2) grinding the solids from the drilling fluid to a desired size; (3) pumping the ground solids and the drilling fluid to a hydrocyclone so as to produce an overflow and an underfloor in which the overflow contains low-density solids and the underflow contains high-density solids; and (4) passing the high-density solids to a container.

In the process of the present invention, the high density solids are mixed with the drilling fluid in the container. The solids-containing drilling fluid is shaken so as to remove oversize solids from the drilling fluid. The step of shaking occurs prior to the step of grinding. The solids are ground such that the solids have control minimal size, such as ¼ inch. The ground solids are pumped to the hydrocyclone at a generally constant pressure. In particular, the ground solids are pumped by a positive displacement pump at a pressure of between 50 and 125 p.s.i.

In the process of the present invention, the low-density solids from the hydrocyclone are centrifuged so as to produce a liquid overflow and an underflow of undersized particles. The liquid overflow from the centrifuge can be added to the high-density solids from the hydrocyclone. In one embodiment the present invention, the high-density solids are mixed with the drilling fluid and the mixed high-density solids and drilling fluid can be pumped to a well. In those circumstances where a dual density drilling fluid is used, the process of the present invention additionally mixes the liquid overflow from the centrifuge with the drilling fluid and then pumps the mixed liquid overflow as drilling fluid to a riser.

In the present invention, the hydrocyclone can include a plurality of hydrocyclones arranged in parallel relationship. As such, the step of pumping will include pumping the ground solids in the drilling fluid to an inlet of each of the plurality of hydrocyclones, discharging and an overflow of the low-density solids from each of the plurality of hydrocyclones, and discharging an underflow of the high-density solids from each of the plurality of hydrocyclones.

The present invention is also a system for recovering solids from a drilling fluid. The system comprises a grinder suitable for grinding particles from the drilling fluid to a desired size, a hydrocyclone, and a tank. The hydrocyclone is fluidically connected to the grinder. The hydrocyclone has a first outlet adjacent the top thereof and a second outlet adjacent a bottom thereof. The first outlet is suitable for passing an overflow of the low-density drilling fluid therefrom. The second outlet is suitable for passing a high-density drilling fluid therefrom. The tank has an inlet connected or interconnected to the second outlet of the hydrocyclone so as to receive the high-density drilling fluid therein.

In the system of the present invention, a pump is fluidically positioned between the grinder and the hydrocyclone. The pump has an inlet connected to an outlet of the grinder. The pump has an outlet connected to an inlet of the hydrocyclone. In the preferred embodiment of the present invention, the pump is a positive displacement pump. This positive displacement pump provides a pressure of between 50 and 125 p.s.i. to the drilling fluid passing therethrough.

A centrifuge is fluidically connected to the first outlet of the hydrocyclone. The centrifuge has an overflow outlet and an underflow outlet. The underflow outlet allows undersized particles to pass therethrough. The overflow outlet allows drilling fluid to pass therethrough. A shaker is positioned upstream of the grinder. The shaker serves to remove oversize particles from the drilling fluid prior to passing to the grinder. A mud additive line can be connected to the tank so as to allow an additive fluid to be added to the high-density drilling fluid in the tank so as to control the density of the high-density drilling fluid in the tank. A mud pump is in fluid communication with this tank. The mud pump is suitable for pumping the high-density drilling fluid to the well. Another mud pump to be cooperative at the overflow outlet of the centrifuge so as to pump the drilling fluid to a riser.

The foregoing Section is intended to describe, with particularity, the preferred embodiment of the present invention. It is understood that modifications to this preferred embodiment can be made within the scope of the present invention without departing from the spirit of the invention. As such, this Section should not to be construed, in any way, as being limiting of the broad scope of the present invention. The present invention should only be limited by the following claims and their legal equivalents.

DETAILED DESCRIPTION OF THE INVENTION

Figure 1:
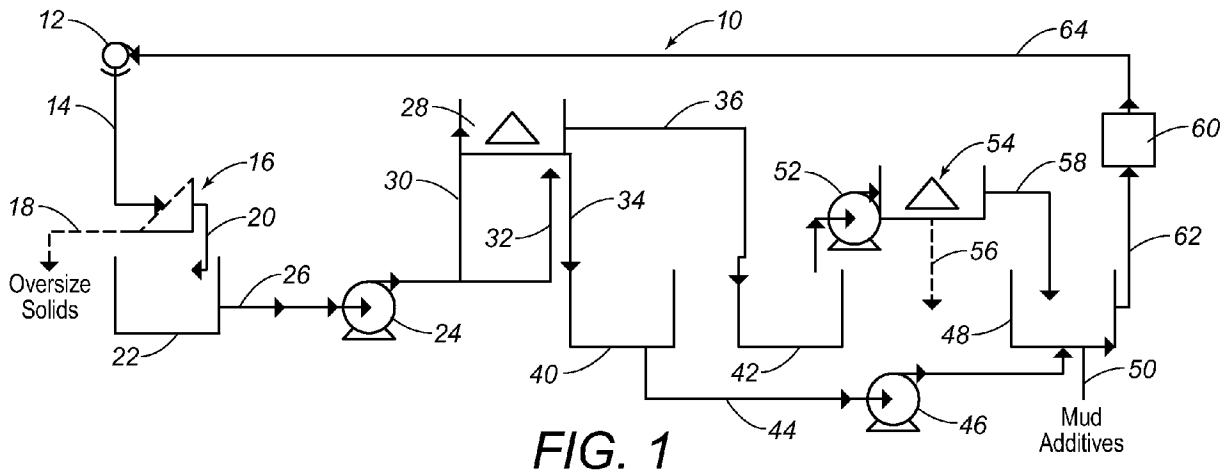
FIG. 1 Prior Art
FIG. 1 is a flow diagram showing a prior art centrifuge-based system for the recovery of solids from a drilling fluid.
Figure 2:
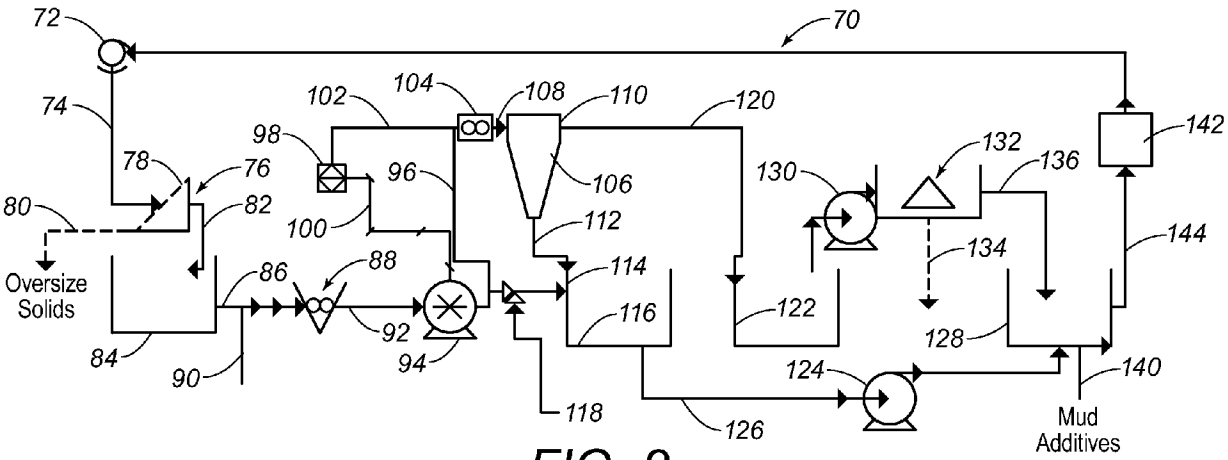
FIG. 2 is a flow diagram of one embodiment of the process of the present invention for the recovery of solids from a drilling fluid.

Referring to FIG. 2, there shown the system 70 for the recovery of solids from a drilling fluid. The system 70 includes a drilling rig 72. The drilling rig 72 utilizes drilling mud or drilling fluids. The drilling rig will pass the solids-containing drilling fluid through line 74 toward a shaker 76. The shaker 76 is in the nature of shaker systems manufactured by Fluid Systems, Inc. of Houston, Tex. The shaker system 76 can utilize a vibrating screen 78 such that relatively large particles from the solids-containing drilling fluid will contact the screen and be removed from the remaining drilling fluid along line 80 for disposal as oversize solids. Typically, it is the intention of the shaker system 76 to remove large particles having a diameter of greater than 100 microns. As such, a drilling fluid containing much smaller particles will pass as an underflow along line 82 from the shaker system 76. This reduced-size solids-containing drilling fluid is then delivered into a first tank 84.

It is important to the concept of the present invention that the shaker system 76 is fully intended to remove a vast majority of the solids from the drilling fluid. However, as is known in practice, holes or openings develop on the screen 78 which can allow for larger particles to flow therethrough. Other problems, including malfunctions or failures, can also occur whereby larger-than-intended particles will flow outwardly of the shaker system 76. As such, although the shaker system 76 is perfectly effective in virtually all applications, there is a possibility that larger-than-intended particles would pass outwardly of the shaker system 76. To a certain extent, these larger-than-expected particles will tend to settle toward the bottom of the first tank 84.

A line 86 extends from the first tank 84 toward a grinder 88. A dilution line 90 is in communication with the line 86 so as to add additional fluid to the fluid passing through line 86, as desired. The grinder 88 is in the nature of a grinder pump. This grinder 88 will serve to act on the fluid passing through line 86 so as to further grind any particles that exist within the end the solids-containing containing drilling fluid from line 86. Typically, the grinder 88 will assure that no particles of greater than a desired maximum size (such as approximately ¼ inch) will pass from the grinder 88 into line 92. As stated previously, in the event that larger-than-intended particles should pass from the shaker system 76, the grinder 88 will assure that none of these larger-than-expected particles will emerge therefrom. As such, the grinder 88 provides assurance that any particles that are within the drilling fluid passing through line 92 are the size of less than that which would clog the hydrocyclone. Various type of grinder pumps are known in the art such as impeller-based grinders, shear grinders, and other technologies.

The solids-containing drilling fluid is drawn through the grinder 88 by way of pump 94. In the present invention, the pump 94 is a positive displacement pump. It is known that positive displacement pumps provide a constant pressure to the fluid passing therethrough. One form of a positive displacement pump that is particularly useful in the present invention would be a progressive cavity pump. Within the concept of the present invention, it is important to be able to control pressures. Ideally, within the concept of the present invention, the pump 94 will apply a pressure of between 50 p.s.i. to 125 p.s.i. to the fluid passing therethrough. The fluid from the pump 94 will pass along line 96 under pressure.

FIG. 2 shows that there is a variable frequency drive 98 that is electrically connected by line 100 to the positive displacement pump 94. As such, the variable frequency drive 98 controls the operating pressure of the pump 94 in a controlled manner. The variable frequency drive 98 is electrically connected by line 102 to suitable gauges 104. Gauges 104 are also operatively connected to the line 96 so as to detect pressure, temperature, velocity, and other flow components associated with the flow of pressurized fluid through the line 96. As such, the gauges 104 are cooperative with the control system associated with the variable frequency drive 98 such that a proper control of the pressure passing through the line 96 is achieved.

The control of pressure and the maintenance of proper pressures is important because of the use of the hydrocyclone 106. The hydrocyclone 106 includes an inlet 108 positioned adjacent to a top of the hydrocyclone. The hydrocyclone 106 also includes a first outlet 110 positioned adjacent to the top of the hydrocyclone and a second outlet 112 positioned adjacent to the bottom of the hydrocyclone 106.

The hydrocyclone 106 is a device that serves to classify, separate or sort particles in a liquid suspension based on the ratio of their centripetal force to fluid resistance. This ratio is high for dense (where separation by density is required) and coarse (where separation by size is required) particles, and low for light and fine particles. The hydrocyclone has a cylindrical section at the top where the liquid is being fed tangentially, at a conical base. The angle, and hence length of the conical section, plays a role in determining the operating characteristics. The hydrocyclone has a pair of outlets 110 and 112. The smaller outlet 112 is at the bottom so as to provide for the release of the underflow fluid. The larger outlet 110 is adjacent to the top of the hydrocyclone 106 so as to allow for the release of the overflow liquid. The underflow will be the denser or coarser fraction while the overflow is the lighter or finer fraction. Internally, inertia is countered by the resistance of the liquid, with the effect that larger or denser particles are transported to the wall for eventual exit at the underflow outlet 112 with a limited amount of liquid, while the finer or less dense particles remain in the liquid and exit at the overflow outlet 110 through a tube extending slightly into the body of the hydrocyclone at the center.

As can be seen in FIG. 2, the underflow outlet 112 is connected to a line 114 so that the high density drilling fluid is passed to a tank 116. The pump 94 also has a pressure relief line 118 that can be connected away from the pump 94 or toward the tank 116. As such, if access pressures should occur by virtue of the positive displacement pump 94, these pressures can easily be released through the pressure relief 118. The overflow outlet 110 allows the low density liquid to flow outwardly along line 120 to another tank 122. As such, the high density drilling fluid can be stored in tank 116 while the low-density drilling fluid can be stored in tank 120. Within the concept of the present invention, each of the "tanks" described herein can have a variety of configurations. Most generally, these will be referred to as a "container". In other circumstances, they can be in the nature of pits or flow lines.

A pump 124 is operatively connected to the line 126 extending from the tank 116. As such, pump 124 will serve to deliver the high-density drilling fluid (containing barite) toward another tank 128. As such, the tank 128 will contain a substantial amount of the high-gravity solids, such as barite or hematite. A relatively small amount of liquid will also be retained within the rank 120. The low-density fluid within the tank 122 is passed by pump 130 to a centrifuge 132. Centrifuge 132 serves to process the low-gravity solids from the drilling fluid. These low-density solids will be in the nature of fine cuttings. In the past, these very fine low density solids have simply been accepted in the past and the drilling mud has been routinely returned to the mud system was such very fine solids entrained in the mud. This practice was particularly deleterious to the mud system because the very fine solids have an adverse impact on the viscosity of the drilling mud. As such, the centrifuge 132 utilized so as to allow for the discharge of these very fine low density solids along line 134. The liquid can then flow from centrifuge 132 as an overflow along line 136. This liquid is returned to the tank 128 so as to properly mix with the high-gravity solids in the high-density drilling fluid within the tank 128. If the high-density drilling fluid with tank 128 is not of a sufficient quality to meet the requirements of the drilling system, mud additives can be added along line 140 into the tank 128 so as to bring the drilling fluid to its required viscosity and density.

A mud pump 142 is in communication along line 144 with the tank 120 so as to process the drilling fluid back through the system.

Is important to note that the system 70 of the present invention is particularly useful for removing barite and hematite from the drilling fluid. As such, these very expensive and scarce components of the drilling fluid are preserved. The system 70 minimizes the requirements to add additional barite to the drilling fluid. Since substantially all of the barite is preserved, the present invention overcomes those problems associated with a loss of barite.

In the past, and is not been believed proper or possible to utilize hydrocyclones for the purpose of separating the high-gravity solids from the drilling fluid. Hydrocyclones are static devices with no moving parts. As such, whenever particles are passed through a hydrocyclone, clogging of the hydrocyclone regularly occurs. As such, delay in the processing system will occur while replacement or repair is carried out. In spite of the use of various screening systems, large particles do flow through the system such as that clogging of the hydrocyclone would become a possibility. In the present invention, however, these problems are resolved by the use of the grinder 88 placed downstream from the shaker system 76. In additionally, these problems are overcome by the use of the positive displacement pump 94 which assures that a proper pressure is applied to the solids-containing drilling fluid passing into the hydrocyclone. The monitoring of the conditions of the fluid flow further assures that the hydrocyclone avoids clogging.

Importantly, in the present invention, to further avoid any problems associated with the clogging of the hydrocyclone, the hydrocyclone 106 can be in the nature of a plurality of hydrocyclones that are arranged in parallel relationship to each other. As such, each of the array of hydrocyclones will have an inlet that receives the solids-containing drilling fluid as pumped by the positive displacement pump 94. A suitable manifold can be associated with the inlets to each of the hydrocyclones so as to assure an even flow of fluid into each of the hydrocyclones. As such, if a single hydrocyclone should become clogged, the remaining hydrocyclones in the array will compensate for any clogging of this hydrocyclone. As such, replacement of the hydrocyclone can occur on-the-fly without any interruption in the processing system 70.

Importantly, a hydrocyclone would have the capacity of processing approximately twenty-five gallons of fluid per minute. Typically, such a single hydrocyclone would not be suitable for processing the large volume of liquid associated with the drilling system. However, since the hydrocyclones can be arranged in an array of hydrocyclones, the number of hydrocyclones can be adapted to the requirements of the system. For example, if 2500 gallons per minute of liquid require processing, then one hundred hydrocyclones could be provided in an array so as to meet these requirements. This is in contrast to the relatively low processing capabilities of a centrifuge. Typically, centrifuges only have the capacity to process approximately 400 gallons per minute. As such, additional centrifuges would be required in order to meet the requirements of such a system or the system would be inadequate for processing the fluid so as to remove all of the barite from the fluid. The addition of centrifuges (so as to meet the requirements of the system) is exceedingly expensive. The present invention, through the use of the hydrocyclone, along with the other components, effectively meets the requirements of the mud system of the drilling operation.

Figure 3:
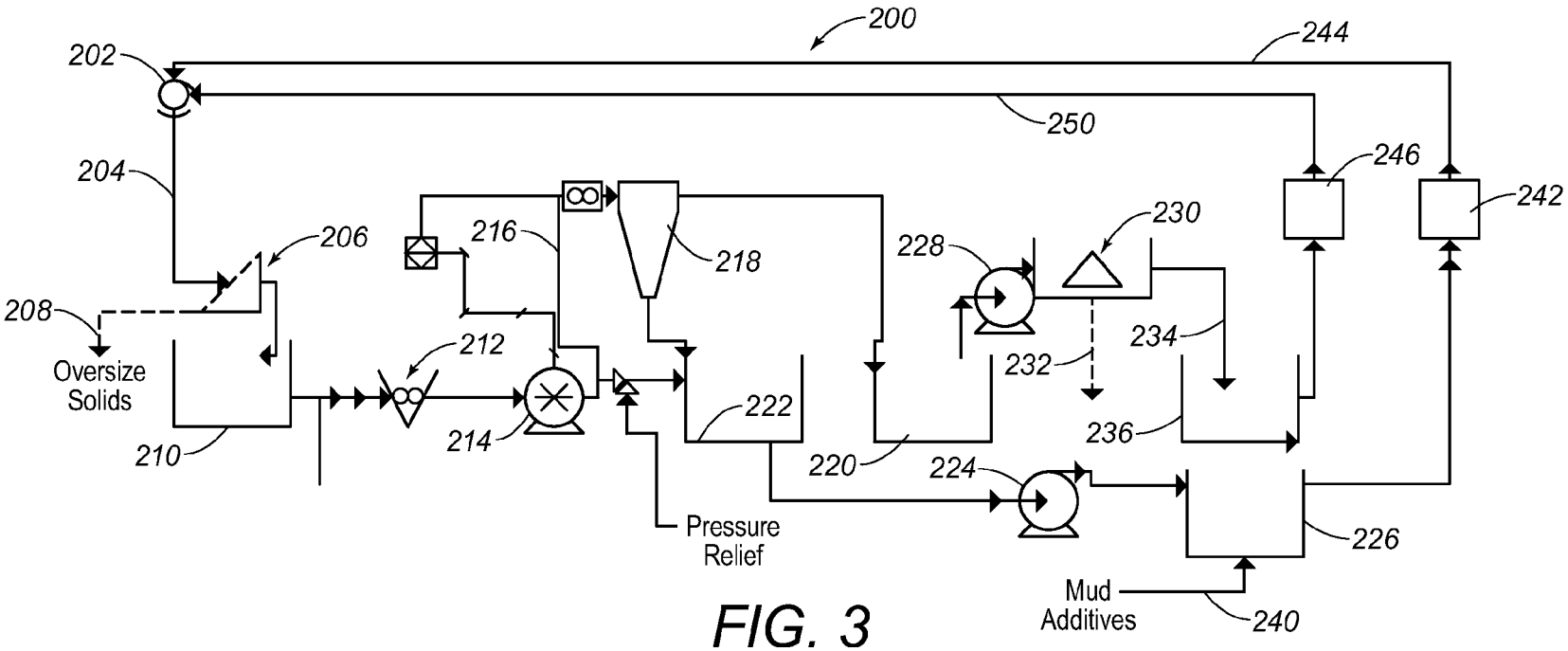
FIG. 3 is a flow diagram of an alternative embodiment of the process for recovering solids from a drilling fluid.

FIG. 3 shows an alternative embodiment of the present invention and shows, in particular, the system 200 for the processing of drilling fluid. As with the previous embodiment, a drilling rig 202 is provided so as to pump solids-containing drilling fluid along line 204 to a shaker system 206. The shaker system 206 has a discharge outlet 208 so as to remove oversize solids. The solids-containing liquid is then passed into a tank 210. The liquid in tank 210 can then be processed through the grinder 212 and through the pump 214 in the nature of the previous embodiment. The pump will deliver the fluid along line 216 to the hydrocyclone 218. The overflow of the hydrocyclone will be delivered to the tank 220. The barite-containing high-density drilling fluid is delivered to a tank 222. Pump 224 draws the high-density drilling fluid from the tank 222 to another tank 226. The low-density drilling fluid in tank 220 is drawn by pump 228 into a centrifuge 230 in the nature of the previous embodiment of the present invention. The centrifuge 230 will remove those fine particles from the drilling fluid so as to allow for the removal of undersized solids along line 232. The remaining low-density drilling fluid will pass along line 234 into another tank 236.

Importantly, as can be seen in FIG. 3, the tank 226 will contain the high-density drilling fluid that includes the barite or hematite. Additional mud additives can be added along line 240 so as to satisfy the requirement of the high-density mud system. A mud pump 242 draws the high-density drilling fluid from the tank 226 as high-density mud to the well along line 244. The low-density drilling mud will be passed by pump 246 to the riser along line 200 and 250. Suitable additives can be utilized in association with the low-density drilling fluid in the tank 236 so as to cause such drilling fluid to reach the required viscosity and density.

As can be seen in FIG. 3, the present invention satisfies the requirement for dual density mud systems. In other words, the original solids-containing drilling mud is treated so as to produce a low-density drilling mud and a high-density drilling mud. As such, the present invention is independently able to provide the high-density drilling mud directly to the well while providing the low-density drilling mud to the riser. In each of these circumstances, the high-gravity solids, such as barite or hematite, are preserved.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

We claim:

1. A process for recovery of solids from a drilling fluid, the process comprising:

passing a solids-containing drilling fluid to a shaker;

shaking the solids-containing drilling fluid so as to remove oversize solids from the drilling fluid;

passing the shaken drilling fluid through a grinder so as to grind such that solids in the shaken drilling fluid have a maximum diameter of no more than one-quarter inch;

pumping the ground solids and the drilling fluid at a generally constant pressure to a hydrocyclone, the hydrocyclone producing an overflow and an underflow, the overflow containing low-density solids, the underflow containing high-density solids; and pumping the high-density solids to a container.

2. The process of claim 1, the step of passing the high-density solids comprising:

mixing the high-density solids with a liquid in the container.

3. The process of claim 1, the step of pumping comprising:

pumping the ground solids with a positive displacement pump at a pressure of between 50 and 125 p.s.i.

4. The process of claim 1, further comprising:

centrifuging the low-density solids from the hydrocyclone so as to produce a liquid overflow and an underflow of undersized particles.

5. The process of claim 4, further comprising:

adding the liquid overflow from the centrifuge to the high-density solids from the hydrocyclone.

6. The process of claim 4, further comprising:

mixing the high-density solids with the liquid overflow; and pumping the mixed high-density solids and liquid overflow to a well.

7. The process of claim 6, further comprising:

mixing the liquid overflow from the centrifuge with additional drilling fluid; and passing the mixed liquid overflow and additional drilling fluid to a riser.

8. The process of claim 1, said hydrocyclone comprising a plurality of hydrocyclones arranged in parallel relation, the step of pumping comprising:

pumping the ground solids and the drilling fluid to an inlet of each of said plurality of hydrocyclones;

discharging an overflow of low-density solids from each of said plurality of hydrocyclones; and discharging an underflow of high-density solids from each of said plurality of hydrocyclones.

9. A system for recovering solids from a drilling fluid, the system comprising:

a grinder suitable for grinding particles from the drilling fluid to a desired size;

a shaker positioned upstream of said grinder, said shaker adapted to remove oversize particles from the drilling fluid prior to passing to said grinder;

a hydrocyclone having an inlet fluidly connected or interconnected to said grinder, said hydrocyclone being downstream of said grinder, said hydrocyclone having a first outlet adjacent a top thereof and a second outlet adjacent a bottom thereof, said first outlet suitable for passing an overflow of low-density drilling fluid therefrom, said second outlet suitable for passing a high-density drilling fluid therefrom; and a tank having an inlet connected or interconnected to said second outlet of said hydrocyclone so as to receive the high-density drilling fluid therein; and a mud pump in fluid communication with said tank, said mud pump adapted to pump the high-density drilling fluid to a well.

10. The system of claim 9, further comprising:

a pump fluidically positioned between said grinder and said hydrocyclone, said pump having an inlet connected to an outlet of said grinder, said pump having an outlet connected to said inlet of said hydrocyclone.

11. The system of claim 10, said pump being a positive displacement pump, said positive displacement pump for producing a pressure of between 50 and 125 p.s.i. to the drilling fluid passing therethrough.

12. The system of claim 9, further comprising:

a centrifuge fluidically connected to said first outlet of said hydrocyclone, said centrifuge having an overflow outlet and an underflow outlet, said underflow outlet allowing undersized particles to pass therethrough, said overflow outlet allowing drilling fluid to pass therefrom.

13. The system of claim 9, further comprising:

a mud additive line connected to said tank so as to allow an additive fluid to be added to the high-density drilling fluid in said tank so as to control a density of the high-density drilling fluid in said tank.

14. The system of claim 11, said pump being a progressive cavity pump, said progressive cavity pump passing the drilling fluid under a constant pressure to said inlet of said hydrocyclone.

* * * * *